US007999453B2

(12) United States Patent
Ishida

(10) Patent No.: US 7,999,453 B2
(45) Date of Patent: Aug. 16, 2011

(54) ELECTRON EMITTER AND A DISPLAY APPARATUS UTILIZING THE SAME

(75) Inventor: Takehisa Ishida, Singapore (SG)

(73) Assignee: Sony Corporation, Tokyo (JP)

( * ) Notice: Subject to any disclaimer, the term of this patent is extended or adjusted under 35 U.S.C. 154(b) by 564 days.

(21) Appl. No.: 11/892,251

(22) Filed: Aug. 21, 2007

(65) Prior Publication Data

US 2008/0067912 A1 Mar. 20, 2008

(30) Foreign Application Priority Data

Aug. 24, 2006 (SG) ..... 200605692-3

(51) Int. Cl.
*H01J 1/304* (2006.01)

(52) U.S. Cl. ..... 313/309; 313/311; 313/497

(58) Field of Classification Search ..... 313/311, 313/495–497, 309
See application file for complete search history.

(56) References Cited

U.S. PATENT DOCUMENTS 3,745,402 A * 7/1973 Shelton et al. ..... 428/172
3,840,955 A * 10/1974 Hagood et al. ..... 445/52
5,164,632 A * 11/1992 Yoshida et al. ..... 313/309
6,034,468 A * 3/2000 Wilshaw ..... 313/309
2002/0185949 A1 12/2002 Yaniv et al.
2005/0276743 A1 * 12/2005 Lacombe et al. ..... 423/447.3
2006/0046602 A1 3/2006 Kang
2006/0054879 A1 3/2006 Jin
2007/0085459 A1 * 4/2007 Hudspeth et al. ..... 313/309

FOREIGN PATENT DOCUMENTS

KR 2001-0077687 A 8/2001

OTHER PUBLICATIONS

Austrian Patent Office; Application No. 200605692-3; Filing Date: Aug. 24, 2006.

* cited by examiner

*Primary Examiner* — Karabi Guharay
(74) *Attorney, Agent, or Firm* — Rader, Fishman & Grauer PLLC

(57) ABSTRACT

A field effect electron emitting apparatus comprising an insulating layer having an array of pores is disclosed, each pore has at least one nano-wire electron emitter which is shorter than the pore, and/or each pore may have a plurality of nano-wire electron emitters. A method of manufacturing a electron emitting array is also disclosed. The field effect electron emitting apparatus may be used in a display.

19 Claims, 4 Drawing Sheets

A-A' cross section

ELECTRON EMITTER AND A DISPLAY APPARATUS UTILIZING THE SAME

CROSS REFERENCE TO RELATED APPLICATION

This application is cross referenced to a related co-pending application filed on the same date, titled "An electron emitter and a display apparatus utilizing the same", naming Takehisa Ishida and Wei Beng Ng as the inventors.

FIELD OF THE INVENTION

The present invention relates to an electron emitter and a display apparatus utilising the same, particularly, though not exclusively, to a field effect electron emitting apparatus, a field effect display, a method of fabricating a electron emitter array, and a method of manufacturing a field effect display.

BACKGROUND

Recently, flat panel displays (FPD) have become popular due to their smaller footprint and larger, flatter screen compared to conventional technology. For example, liquid crystal displays (LCD) and plasma display panels (PDP) are replacing cathode ray tubes (CRT) in many domestic applications. However, some types of FPD technology have disadvantages compared to conventional CRT technology. For example, LCDs have a slow response rate, which degrades the quality of fast-moving images, and PDPs have a reduced life expectancy.

An alternative technology to LCD or PDP is a field emission display (FED). A typical FED incorporates a large array of fine metal tips or carbon nano-tubes (CNT), which emit electrons through a process known as field emission. The array of electron emitters lies behind a phosphor coated screen, which, similar to a CRT, emits light when the electrons strike.

There are many challenges to the commercial fabrication of such devices. The use of CNT electron emitters, for example, may improve the potential performance of FEDs but adds further complexity to the fabrication process.

United States Patent publication number 2006/0046602 discloses a method of manufacturing a field emitter electrode using self-assembling carbon nanotubes as well as a field emitter electrode manufactured thereby. The method comprises anodizing an aluminum substrate to form an anodized aluminum oxide film having a plurality of uniform pores on the aluminum substrate, preparing an electrolyte solution having carbon nano-tubes dispersed therein, immersing the anodized aluminum substrate in the electrolyte solution and applying a given voltage to the aluminum substrate as one electrode, so as to attach the carbon nano-tubes to the pores, and fixing the attached carbon nano-tubes to the pores. The suggested application is as a back light for an LCD, and a gate electrode is not disclosed.

The emitter current for those prior art devices above can be quite high, which reduces the life expectancy. Also, the CNT for those prior art devices above are longer than the depth of the pore. In other words, the tips of the CNT are exposed from the pores. It would be desirable therefore to provide an electron emitter array which has a fast response, a long lifetime, an uniformity and/or a high luminous intensity and/or improved methods of fabrication.

SUMMARY OF THE INVENTION

It is therefore the objective of at least one embodiment to provide a field effect emitting apparatus that overcomes at least one of the above mentioned problems.

In general terms, a first aspect of the invention proposes that in a field effect emitting apparatus comprising an insulating layer having an array of pores, each pore has at least one nano-wire electron emitter which is shorter than the pore. This may give the advantage that a gate electrode may be provided on or near the insulating layer without the need for a spacer between them.

A second independent aspect of the invention is that each pore may have a plurality of nano-wire electron emitters. This may give the advantage that the life of the emitter is improved because the current emitted from one nano-wire can be reduced to obtain the same amount of current in comparison with the case of using only one nano-wire in a single pore.

In a first specification expression of the invention, there is provided a field effect electron emitting apparatus comprising;

a cathode;

an insulating layer on or adjacent to the cathode having an array of pores;

at least one nano-wire electron emitter within each pore, each nano-wire electron emitter being shorter than the pore and connected to the cathode; and a gate electrode on or adjacent to the insulating layer.

In a second specification expression of the invention, there is provided a field effect electron emitting apparatus comprising;

a cathode;

an insulating layer on or adjacent to the cathode having an array of pores;

a plurality of nano-wire electron emitters in each pore connected to the cathode; and a gate electrode on or adjacent to the insulating layer.

In a third specification expression of the invention, there is provided a field effect electron emitting apparatus comprising;

a cathode;

an insulating layer on or adjacent to the cathode having an array of pores;

at least one electron emitter within each pore, each electron emitter being shorter than the pore and connected to the cathode;

a gate electrode on or adjacent to the insulating layer; and a secondary electron emission (SEE) layer on the sidewall of each pore.

In a forth specification expression of the invention, there is provided a field effect display comprising;

a field effect electron emitting apparatus as described above; and a phosphor coated screen on or spaced parallelly to the field effect electron emitting apparatus.

In a fifth specification expression of the invention, there is provided a method of fabricating an electron emitter array comprising:

providing a cathode;

providing a insulating layer including an array of pores on or adjacent to the cathode;

providing at least one nano-wire electron emitter within each pore, each nano-wire electron emitter being shorter than the pore and connected to the cathode; and providing a gate electrode on or adjacent to the insulating layer.

In a sixth specification expression of the invention, there is provided a method of fabricating an electron emitter array comprising:

providing a cathode;

providing a insulating layer including an array of pores on or adjacent to the cathode;

providing a plurality of nano-wire electron emitters in each pore connected to the cathode; and providing a gate electrode on or adjacent to the insulating layer.

In a seventh specification expression of the invention, there is provided a method of fabricating an electron emitter array comprising;

providing a cathode;

providing a insulating layer including an array of pores on or adjacent to the cathode, providing at least one nano-wire electron emitter in each pore, each electron emitter being shorter than the pore and connected to the cathode;

providing a gate electrode on or adjacent to the insulating layer; and providing a secondary electron emission (SEE) layer on the sidewall of each pore.

In an eighth specification expression of the invention, there is provided a method of fabricating a field effect display comprising;

providing an electron emitter array according to the method as described above; and providing a phosphor coated screen on or spaced parallelly to the electron emitter array.

BRIEF DESCRIPTION OF THE DRAWINGS

One or more example embodiments of the invention will now be described, with reference to the following figures, in which:

FIG. 2(*b*) is a cross section of FIG. 2(*a*);

FIG. 3(*b*) is a cross section of an alternative example of the screen in FIG. 1;

DETAILED DESCRIPTION

Figure 1:
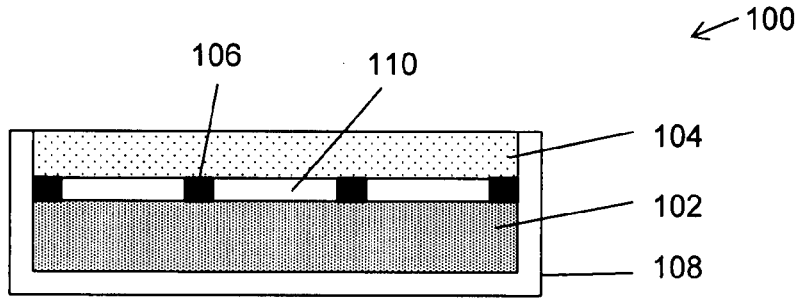
FIG. 1 is a cross section of a display according to an embodiment of the invention.

Referring to FIG. 1 a field emission display (FED) 100 including an emitter array 102 and a phosphor coated screen 104 in a housing 108, is shown. The phosphor coated screen 104 is spaced parallelly to the emitter array 102 by a series of spacers 106. The accelerated electrons from the emitter array 102 collide against the phosphor coated screen 104, and fluorescent light is generated.

Figure 2A:
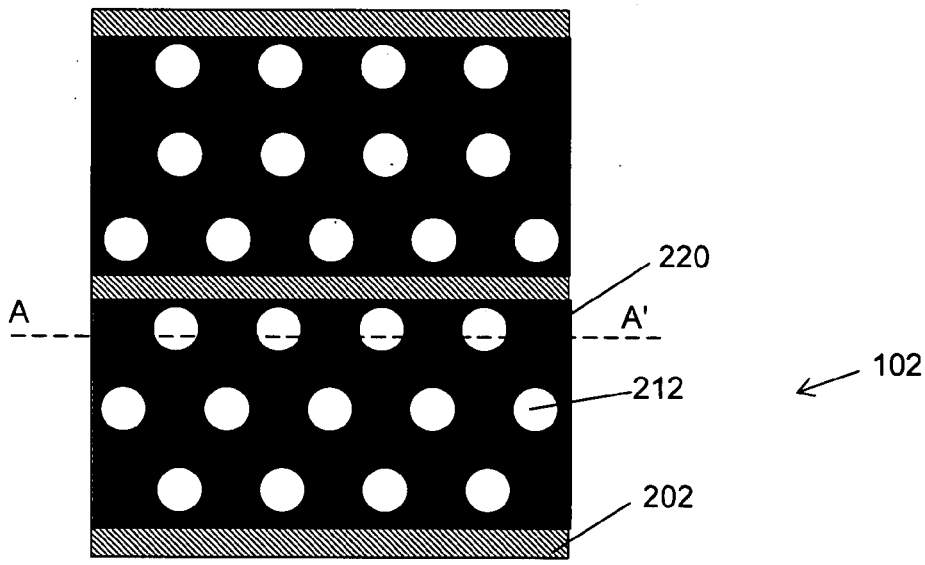
FIG. 2(*a*) is a front view of an example of the emitter array in FIG. 1.
Figure 2B:
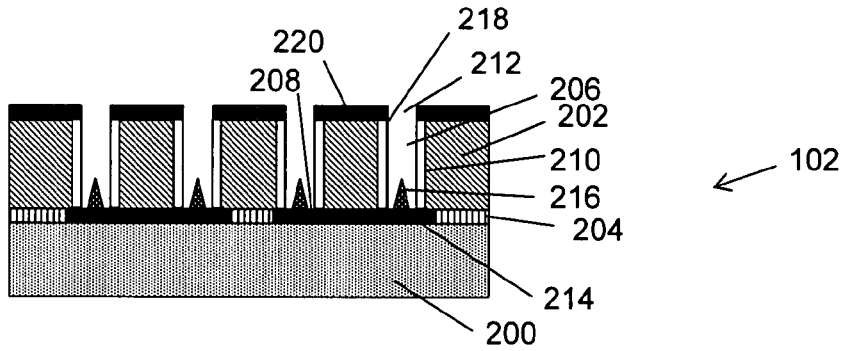

Referring now to FIG. 2, the emitter array 102 is shown in more detail. The emitter array includes a substrate 200, an insulating layer 202, a cathode 214, electron emitters 216 and a gate electrode 220.

The substrate 200 is typically rectangular in shape, and for example, may be made from a sheet of glass typically 1 mm thick.

The insulating layer 202 is attached to the substrate 200 by an adhesive 204, or otherwise deposited. The insulating layer 202 may be made of, for example, aluminium oxide or silicon. The insulating layer 202 has a substantially uniform array of pores, each pore 206 being of sufficient depth and width to accommodate an electron emitter 216. A pore density of more than $10^5/mm^2$, for example $10^6/mm^2$, may result in good uniformity and good luminous intensity.

Each pore 206 in turn contains a base 208, a side wall 210 and an opening 212. The cathode 214 lies on the substrate and forms the base 208 of each pore 206. The electron emitter 216 is connected to the cathode 214 at the base 208. The gate electrode 220 lies on top of the insulating layer 202.

The cathode 214 may be a series of strips which may be independently energized. Alternatively, the cathode 214 may simply be a single element. Each strip 214 is typically rectangular in shape and 100 nm in thickness. Each strip is provided with an external electrical connection at the edge of the substrate.

The gate electrode 220 may be a series of strips which may be independently energized. Alternatively the gate electrode 220 may simply be a single element. Each strip is typically rectangular in cross section and 100 nm in thickness. Each strip is provided with an external electrical connection at the edge of the insulating layer. Each strip has a uniform array of apertures, where each aperture surrounds the opening 212 of one or more pores in the insulating layer.

The strips of the gate electrode, for example, may be arranged generally perpendicularly to the strips of the cathode. This patterning of the strips to intersect perpendicularly, also known as a passive matrix electrode configuration, enables the display of moving pictures. Thus the emitter array is thereby divided into independently controllable pixels at respective intersections of the strips. Each pixel may cover a plurality of emitters 216. To activate each pixel, the respective strip of the gate electrode is energized with a positive voltage with respect to the corresponding strip of the cathode.

Each electron emitter 216 may be made of a conductive material, such as metal or carbon. For example, each electron emitter 216 may have a sharp point or acute tip from which a stream of electrons is emitted. Typically, each electron emitter 216 does not extend past the gate electrode. For example, each electron emitter 216 may be shorter than the pore, such as less than half the length of the pore. Typically, each electron emitter includes at least one nano-wire. In this document, the term nano-wire is used to mean an elongate conductor less than 500 nm in width. For example, each electron emitter may include a plurality of nano-wires, such as carbon nano-tubes.

On the side wall 210 of each pore 206, there may be a secondary electron emission (SEE) layer 218. Typically, each SEE layer 218 is 50 nm in thickness and is made from, for example, magnesium oxide, diamond-like carbon or amorphous carbon nitride.

Figure 3A:
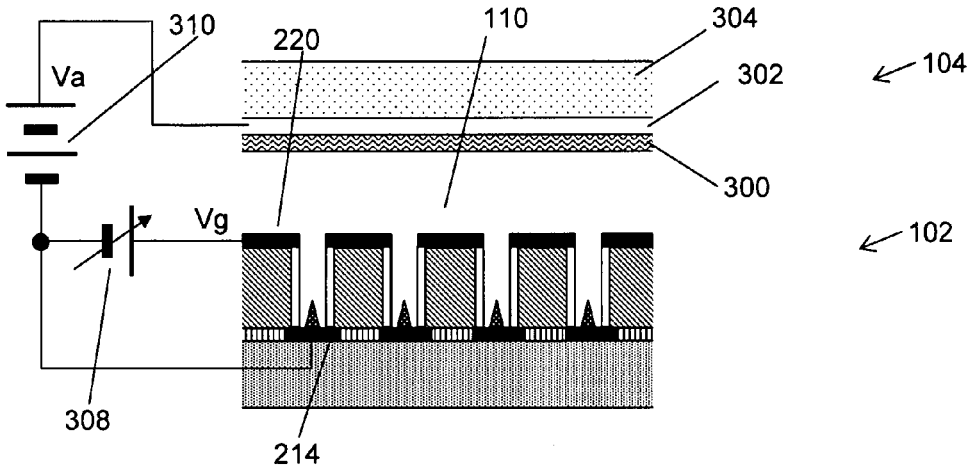
FIG. 3(*a*) is a cross section of an example of the screen in FIG. 1.
Figure 3B:
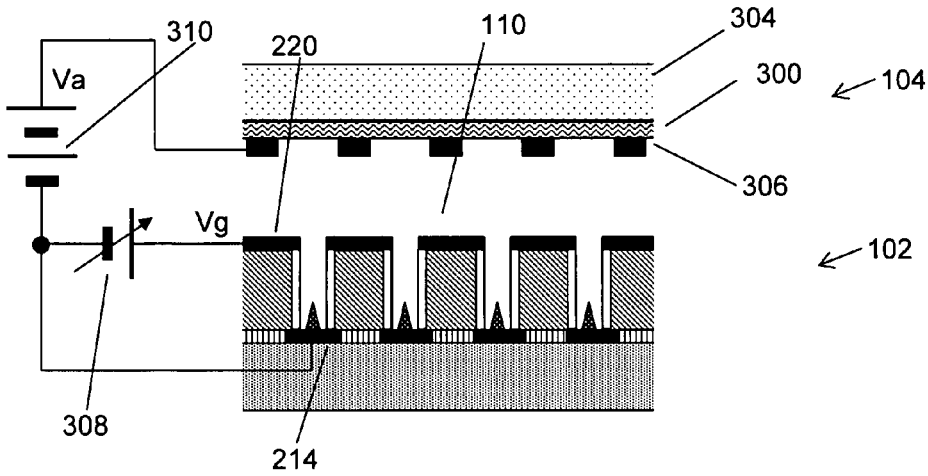

Referring now to FIG. 3(*a*) and FIG. 3(*b*), the phosphor coated screen 104 is shown in more detail. The phosphor coated screen 104 includes a phosphor layer(s) 300, an anode(s) 302 and a glass plate 304. As seen in FIG. 1, the distance between the phosphor coated screen 104 and the emitter array 102 is maintained by spacers 106. A cavity 110 in the housing 108, between the phosphor coated screen 104 the electron emitter 102 and the spacers 106, is maintained as a vacuum, for example $10^{-5}$ Pa.

The anode 302 may be a conductive, transparent, sheet-like electrode 302 between the phosphor layer 300 and the glass plate 304, as shown in FIG. 3(*a*). Alternatively, as seen in FIG. 3(*b*), the anode 302 may be a conductive grid-like electrode 306 between the phosphor layer 300 and the cavity 110. In a further alternative, the anode 302 may be coated between the phosphor layer 300 and the cavity 110. In this case, aluminium also may be utilized. The accelerated electrons penetrate the aluminium anode and collide against the phosphor layer 300. The aluminium anode between the phosphor layer 300 and the cavity 110 also acts as a reflective layer, which enhances the generated light from the phosphor.

A voltage Vg is applied by a variable voltage source 308 between the cathode 214 and the gate electrode 220. The voltage between the cathode 214 and the anode 302 is kept at Va by a voltage source 310.

In operation, Vg is applied between the gate electrode 220 and the cathode 214 so that the gate electrode has a positive potential and the cathode has a negative potential. The electron emitter 216 is electrically conductive, so the potential of the electron emitter 216 is equal to that of the cathode. The electric field concentrates on the tip of the electron emitter 216 and electrons are emitted from the tip of the electron emitter 216, and accelerated toward the gate electrode 220.

Where a SEE layer 218 is provided, in the course of travelling through the pore 206, some electrons may bump against the SEE layer 218, which generates a further electron emission. The generated electrons may also bump against the SEE layer 218, generating still further electrons. Thus, emitted electrons originally from the electron emitter are multiplied by the SEE layer 218 and travel toward the gate electrode 220.

The electrons are accelerated through the pore 206 and are emitted from the opening 212. The phosphor coated screen 104 is energized at a higher potential than the gate electrode. The accelerated electrons collide against the phosphor, and fluorescent light is generated.

By controlling the voltage Vg, the energy and/or density of the electron stream, and therefore the intensity of the fluorescent light, can be adjusted. This may be in terms of the average brightness of the display or the brightness of specific emitters or pixels as required in the display of dynamic images.

Method of Fabrication

Figure 4:
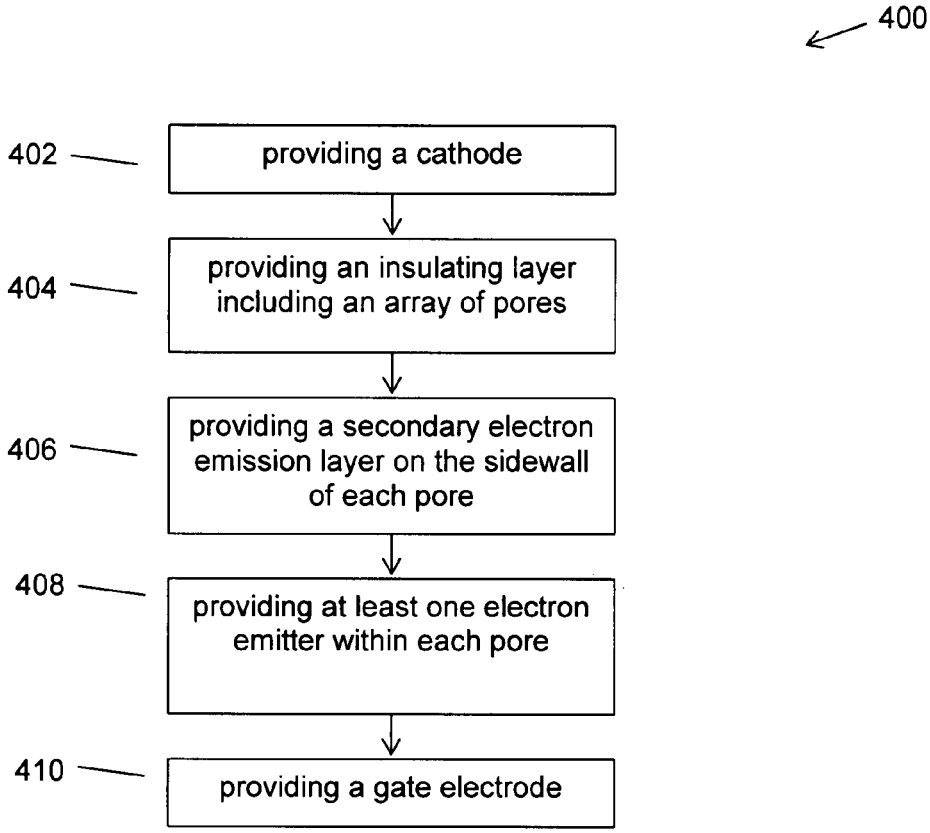
FIG. 4 is a flow chart of a fabrication process according to an embodiment of the invention.

Referring to FIG. 4, a method 400 of fabricating an emitter array for a display is shown. In step 402, a cathode is provided. In step 404, an insulating layer including an array of pores is provided. In step 406, a SEE layer may be provided on the sidewall of each pore. In step 408, at least one electron emitter is provided within each pore. In step 410, a gate electrode is provided. One skilled in the art will appreciate that the order listed is for example only and the method 400 could be implemented in other orders.

Figure 5:
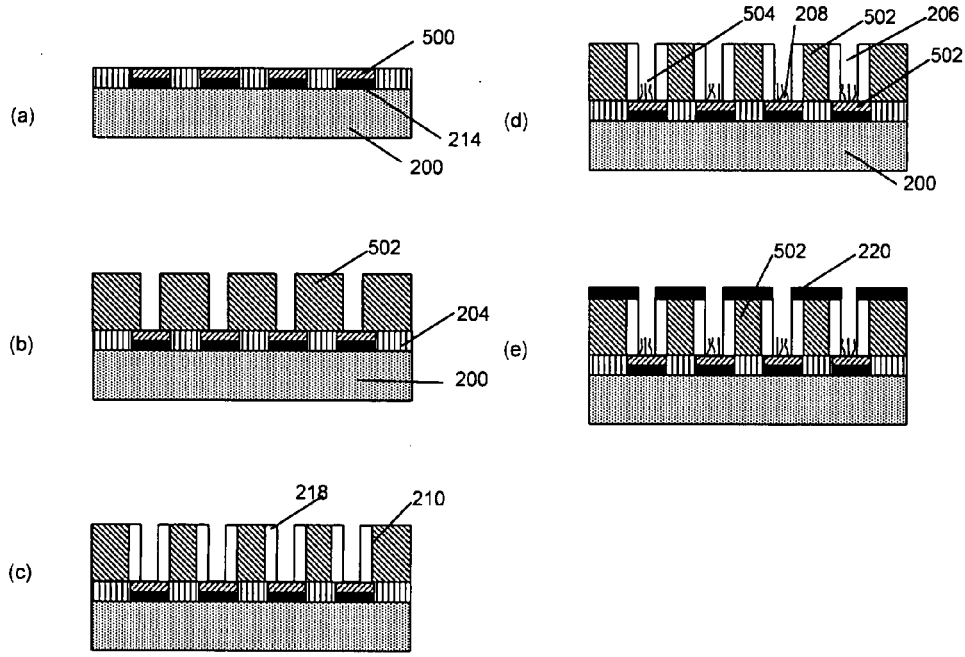
FIGS. 5(*a*) to 5(*e*) are schematics of an implementation of the fabrication process in FIG. 4.

FIG. 5 illustrates one implementation of the method 400.

Step 402 may be implemented by depositing cathodes 214 made of tungsten, molybdenum or other suitable material onto a rigid substrate 200, as seen in FIG. 5(*a*).

A catalyst layer 500 is deposited on top of the cathodes 214. Nickel, copper, iron or cobalt can be used for the catalyst layer 500.

Step 404 may be implemented by bonding the insulating layer 202 using the adhesive 204 on top of the substrate 200, as seen in FIG. 5(*b*).

A sheet of anodized aluminium oxide (AAO) is suitable for the insulating layer 202. AAO is formed by anodizing an aluminium sheet in acid. Pores 206 are generated, and a self-assembled lattice and honeycomb-like AAO porous sheet 502 is obtained. This process avoids the numerous steps involved in using photolithographic techniques to form pores. Furthermore, a pore density greater than $10^6/mm^2$ (which is impossible by photolithography) can be obtained. Pore density may be controlled by varying the anodizing conditions for the aluminium sheet. For example, conditions including the concentration of the acid, the applied voltage, the temperature and the surface roughness of the aluminium sheet all affect the pore density.

Step 406 may be implemented by depositing a SEE layer 218 on the sidewall 210 of the pore, as shown in FIG. 5(*c*). Magnesium oxide, diamond-like carbon, and amorphous carbon nitride, for example, may be used for the SEE layer. The SEE layer may be deposited by vacuum evaporation, sputtering or chemical vapour deposition.

Step 408 may be implemented by processing the AAO plate 502 bonded on the substrate 200 by chemical vapour deposition (CVD) in order to produce carbon nano-tubes (CNT) 504 at the base 208 of each pore 206. By controlling the flow of methane gas in plasma toward the plate 202, a number of CNTs 504 grow in each pore 206 from the catalyst layer 500, as shown in FIG. 5(*d*). The CNT provides an apex to concentrate the electric field and emit electrons.

Step 410 may be implemented by depositing the gate electrode 220 on top of the plate 502, as shown in FIG. 5(*e*).

Figure 6:
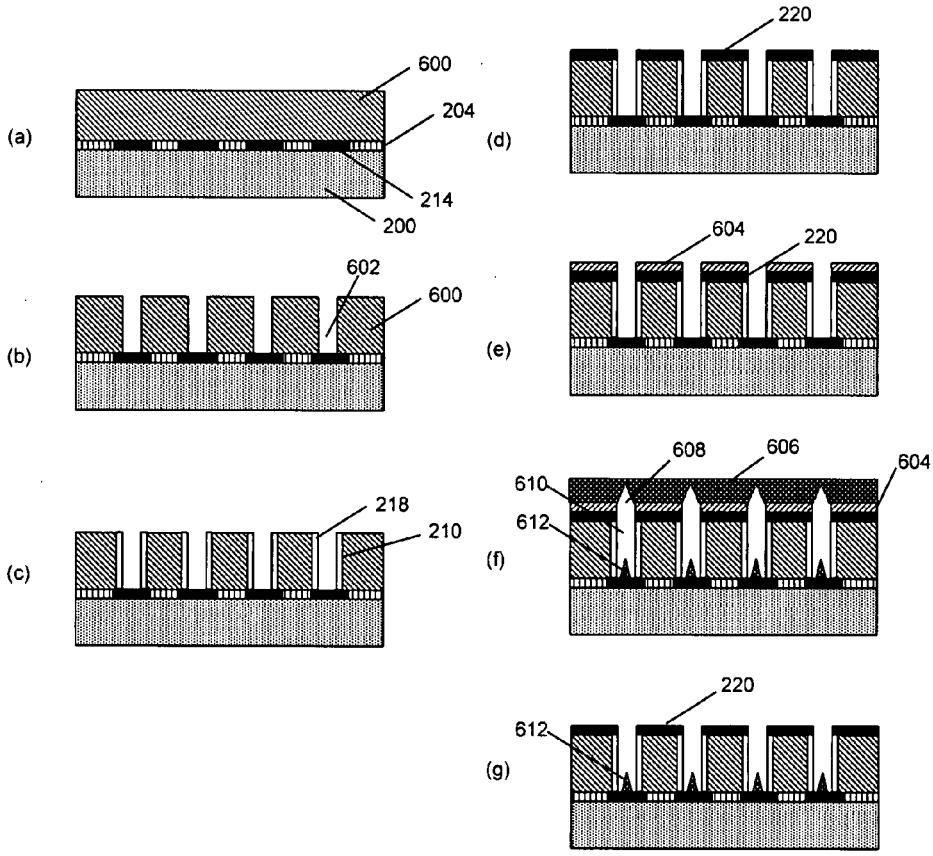
FIGS. 6(*a*) to 6(*g*) are schematics of an alternative implementation of the fabrication process in FIG. 4.

FIG. 6 illustrates an alternative implementation of the method 400.

Step 402 may be implemented by depositing cathodes 214 made of tungsten or molybdenum onto a rigid substrate 200, as seen in FIG. 6(*a*)

Step 404 may be implemented by bonding a silicon wafer 600 on top of the cathodes by using the adhesive layer 204. Pores 602 are patterned in the silicon wafer 600 using photolithography, as shown in FIG. 6(*b*).

Step 406 may be implemented by depositing the SEE layer 218 on the sidewall 210 of the pore, as seen in FIG. 6(*c*). Magnesium oxide, diamond-like carbon, amorphous carbon nitride or other appropriate material is used for the SEE layer. The SEE layer may be deposited by vacuum evaporation, sputtering or chemical vapour deposition.

In this example, step 410 precedes step 408.

Step 410 may be implemented by depositing gate electrode 220 on top of the wafer 600, as shown in FIG. 6(*d*).

Step 408 may be implemented by deposition of a sacrificial layer 604 onto the gate electrodes 220, as seen in FIG. 6(*e*). This is followed by depositing a layer of tungsten, molybdenum or other material 606 onto the sacrificial layer 604. The aperture 608 of the pore 610 is gradually capped with the deposited material, which results in a cone 612 forming at the base of the in the pore, as shown in FIG. 6(*f*). The sacrificial layer 604, together with deposits above the sacrificial layer, are then dissolved with acid or solvent, leaving the cones 612 and the gate electrodes 220, as seen in FIG. 6(*g*).

The emitter array, fabricated according to the above, then may be installed into a housing, together with the spacers, anode and screen. Control electronics are provided to energize the cathode, the gate electrode and the anode according to an input signal and/or stored instructions. Thus each electron emitter can be selectively energized, and the energization varied to achieve the desired display. A skilled reader will also readily appreciate other applications for one or more embodiments, such as in a scanning electron microscope, a backlight of liquid crystal display or a stepper for semiconductor production.

Where AAO is used as the insulating layer, a pore density greater than $10^6/mm^2$ (which is impossible by photolithography) may be achievable. This density provides a good uniformity and luminous intensity as well as a good response speed.

Where a SEE material is used on the sidewall of the pore, emitter current can be reduced, and therefore the lifetime of the emitter may be improved.

Where nano-wire electron emitters are used, a low emission threshold voltage and a good durability may be achieved.

The invention claimed is:

1. A field effect electron emitting apparatus comprising:

a secondary electron emission layer lining a sidewall of a pore, said pore being within an insulating layer;

wherein said secondary electron emission layer is from the group consisting of magnesium oxide, diamond-like carbon, and amorphous carbon nitride, wherein said insulating layer is aluminum oxide or silicon, wherein an electron emitter is within said pore, a cathode being between a substrate and said electron emitter, wherein said electron emitter is less than half the length of said pore.

2. The electron emitting apparatus as claimed in claim 1, wherein said pore is from an array of pores, each of said pores being within said insulating layer.

3. The electron emitting apparatus as claimed in claim 2, wherein a density of said pores in said insulating layer is greater than $10^6/mm^2$.

4. The electron emitting apparatus as claimed in claim 1, wherein said secondary electron emission layer surrounds said electron emitter.

5. The electron emitting apparatus as claimed in claim 1, wherein said insulating layer is between a gate electrode and said substrate, an opening through said gate electrode exposing said electron emitter.

6. The electron emitting apparatus as claimed in claim 1, wherein said electron emitter is electrically connected to said cathode.

7. The electron emitting apparatus as claimed in claim 1, wherein said insulating layer is said aluminum oxide, said electron emitter being a plurality of carbon nano-wires.

8. The electron emitting apparatus as claimed in claim 7, wherein said cathode is between said substrate and a catalyst layer, said catalyst layer being nickel, copper, iron or cobalt.

9. The electron emitting apparatus as claimed in claim 1, wherein said insulating layer is said silicon, said electron emitter being a cone.

10. A field effect display comprising:

the electron emitting apparatus as claimed in claim 1;

a phosphor coated screen on or spaced parallel to said field effect electron emitting apparatus;

an anode on or adjacent to said phosphor coated screen.

11. A method of fabricating an electron emitter array comprising:

a step of forming a pore within an insulating layer, said insulating layer being anodic aluminum oxide or silicon;

a step of lining a sidewall of said pore with a secondary electron emission layer, wherein said secondary electron emission layer is from the group consisting of magnesium oxide, diamond-like carbon, and amorphous carbon nitride, wherein an electron emitter is within said pore, a cathode being between a substrate and said electron emitter, wherein said electron emitter is less than half the length of said pore.

12. The method as claimed in claim 11, wherein said insulating layer is bonded onto said substrate.

13. The method as claimed in claim 12, wherein an adhesive is between said insulating layer and said substrate.

14. The method as claimed in claim 11, wherein said secondary electron emission layer surrounds said electron emitter.

15. The method as claimed in claim 11, wherein said pore is from an array of pores, each of said pores being within said insulating layer.

16. The method as claimed in claim 15, wherein a density of said pores in said insulating layer is greater than $10^6/mm^2$.

17. The method as claimed in claim 11, wherein said insulating layer is said anodic aluminum oxide, said electron emitter being a plurality of carbon nano-wires.

18. The method as claimed in claim 11, wherein said insulating layer is said silicon, said electron emitter being a cone.

19. The method as claimed in claim 11, wherein said insulating layer is between a gate electrode and said substrate, an opening through said gate electrode exposing said electron emitter.

* * * * *